US005340092A

United States Patent [19]

Hecken et al.

[11] Patent Number: 5,340,092

[45] Date of Patent: Aug. 23, 1994

[54] TRANSFER STATION FOR FOUNDRY LADLES

[75] Inventors: Hans J. Hecken, Schuld; Rüdiger Heine, Duisburg; Dietmar Lohse, Wesel; Heinz Möser, Duisburg, all of Fed. Rep. of Germany

[73] Assignee: Mannesmann Aktiengesellschaft, Dusseldorf, Fed. Rep. of Germany

[21] Appl. No.: 112,388

[22] Filed: Aug. 27, 1993

[30] Foreign Application Priority Data

Aug. 27, 1992 [DE] Fed. Rep. of Germany ..... 4228432

[51] Int. Cl.[5] ..... B22D 11/10

[52] U.S. Cl. ..... 266/276; 164/438

[58] Field of Search ..... 266/143, 143, 236, 274, 266/275, 276; 164/438, 437, 335, 336, 337; 222/591

[56] References Cited

U.S. PATENT DOCUMENTS

| | | | |
|---|---|---|---|
| 3,894,576 | 7/1975 | Schoffmann | 164/438 |
| 3,924,517 | 12/1975 | Stulik et al. | 164/438 |
| 4,751,956 | 6/1988 | Bendetti | 266/276 |
| 4,966,349 | 10/1990 | Scheurecker et al. | 266/276 |

*Primary Examiner*—Scott Kastler

*Attorney, Agent, or Firm*—Cohen, Pontani, Lieberman, Pavane

[57] ABSTRACT

A transfer station for transferring foundry ladles from a delivery station situated on the shop floor level to a higher pouting position of a curved continuous-casting installation, and includes a revolving turret with a foundation and supporting arms for receiving the foundry ladle. The arms are guided by paths and are arranged at a column which is rotatably supported on the foundation. A lifting device in the form of a hydraulic cylinder is provided for vertically moving the supporting arms. The lifting device is arranged below the plane of the rotating ring of the column only on the side of the take-over position regardless of the position of the column. The take-over position for the foundry ladle is likewise arranged below the plane of the rotating ting. The paths provided at the column extend below the plane of the rotating ring on the side of the delivery station and are severed in the plane of the rotating ting. A supporting member which can be moved out laterally and serves to support the supporting arms receiving the foundry ladle is arranged above the plane of the rotating ring at the column inside two paths guiding the supporting arms.

3 Claims, 3 Drawing Sheets

TRANSFER STATION FOR FOUNDRY LADLES

BACKGROUND OF THE INVENTION

1. Field of the Invention

The invention relates to a transfer station for transferring foundry ladles from a delivery station situated on the shop floor to a higher pouting position of a curved continuous-casting installation. The transfer station including a revolving turret having vertically movable supporting arms for receiving the foundry ladle, and a hydraulic cylinder for vertically moving the supporting arms.

2. Description of the Related Art

Revolving turrets for the transfer of foundry ladles from a floor conveyor to a continuous casting installation are known, e.g. from EP 0 206 169 B1. Such an installation does without cranes for delivering the foundry ladles, but this installation represents costly technology and is not well-suited to overcome great differences in height between the delivery station and the pouring position.

A further disadvantage is that the revolving turret can only be rotated when both foundry ladles or at least the members of the revolving turret supporting the foundry ladle are located at the height of the pouring position. In case of operating disturbances at the foundry ladle located in the pouring position, e.g. problems with the locking arrangements of the outlet which result in interruptions, much time is wasted in preparing the revolving turret for rotation. Thus, for example, no emergency movement can be immediately carried out when a new foundry ladle has already been delivered or is already located in the supporting arms shortly before the end of pouring.

SUMMARY OF THE INVENTION

Accordingly, it is an object of the present invention to provide a transfer station that avoids the disadvantages mentioned above and achieves an improvement over the known installations with respect to ease of handling.

Pursuant to this object, and others which will become apparent hereafter, one aspect of the present invention resides in a transfer station in which the hydraulic cylinder is arranged below the plane of the rotating ring on the side of the take-over position, regardless of the location of the column. The take-over position for the foundry ladle is also arranged below the plane of the rotating ring. The paths fastened at the column extend below the plane of the rotating ring on the side of the delivery station and are severed in the plane of the rotating ring. Additionally, a supporting member which can be moved out laterally and serves to support the supporting arms receiving the foundry ladle is arranged above the plane of the rotating ring at the column inside two paths guiding the supporting arms.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
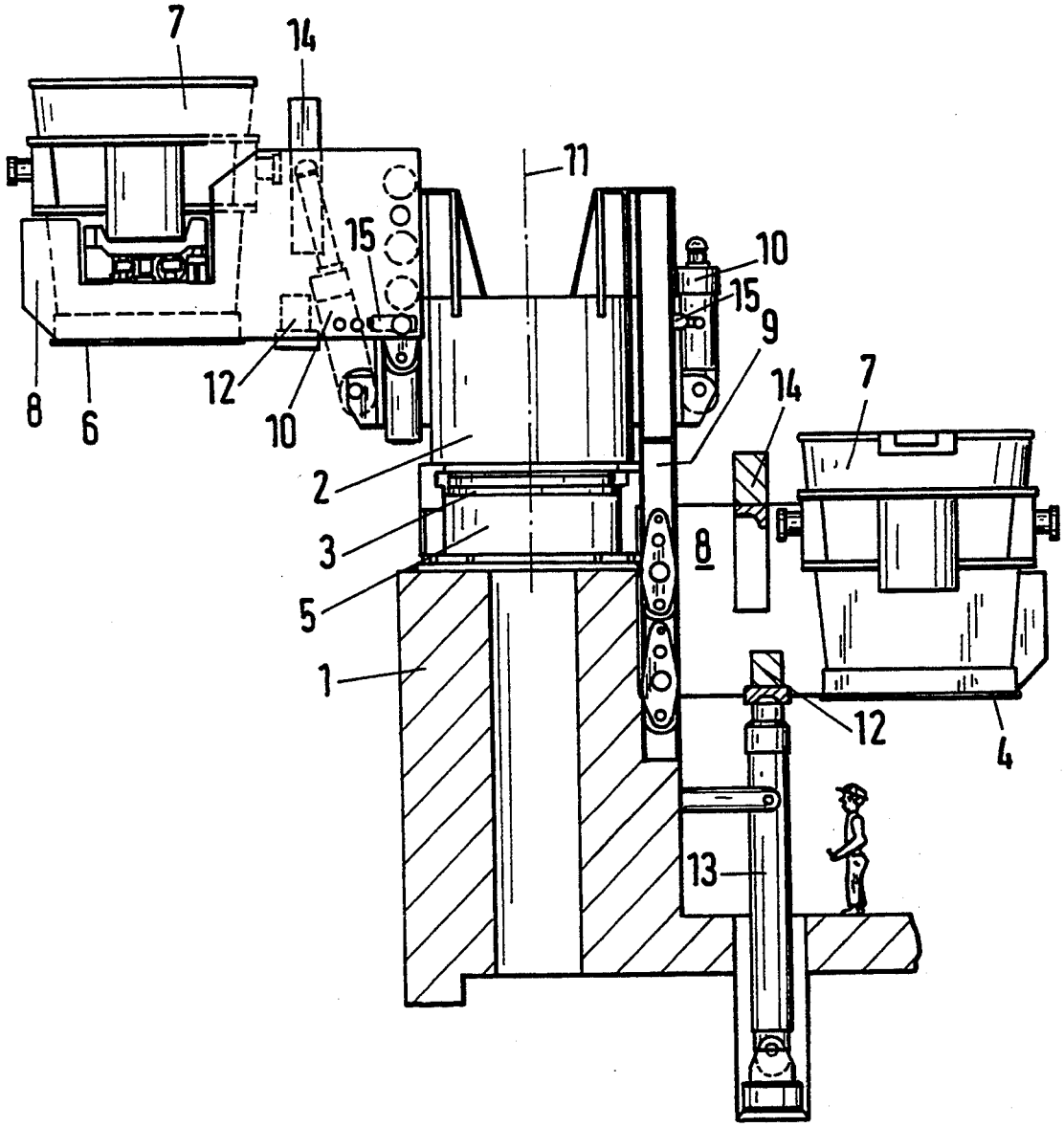
FIG. 1 shows a view of the transfer station.
Figure 2:
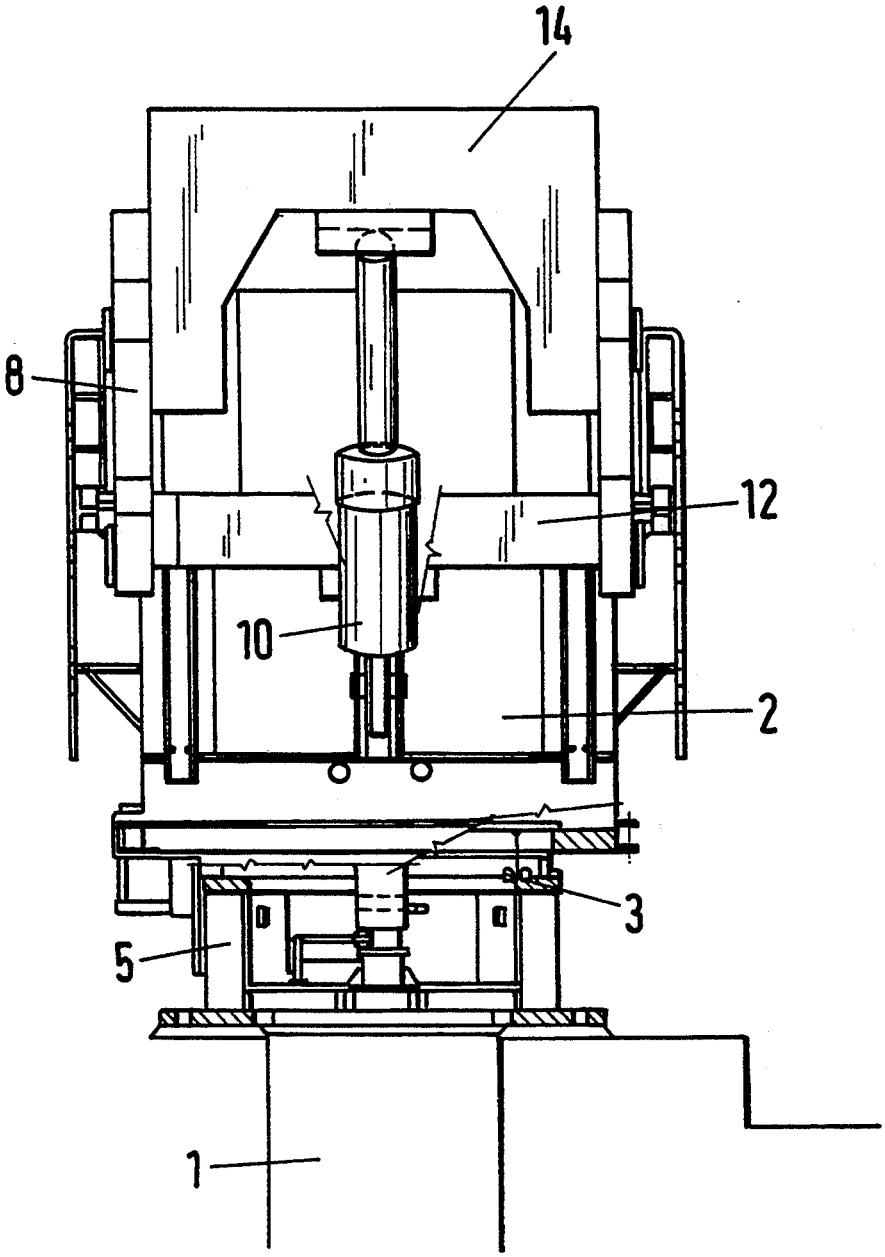
FIG. 2 shows a side view of the transfer station.
Figure 3:
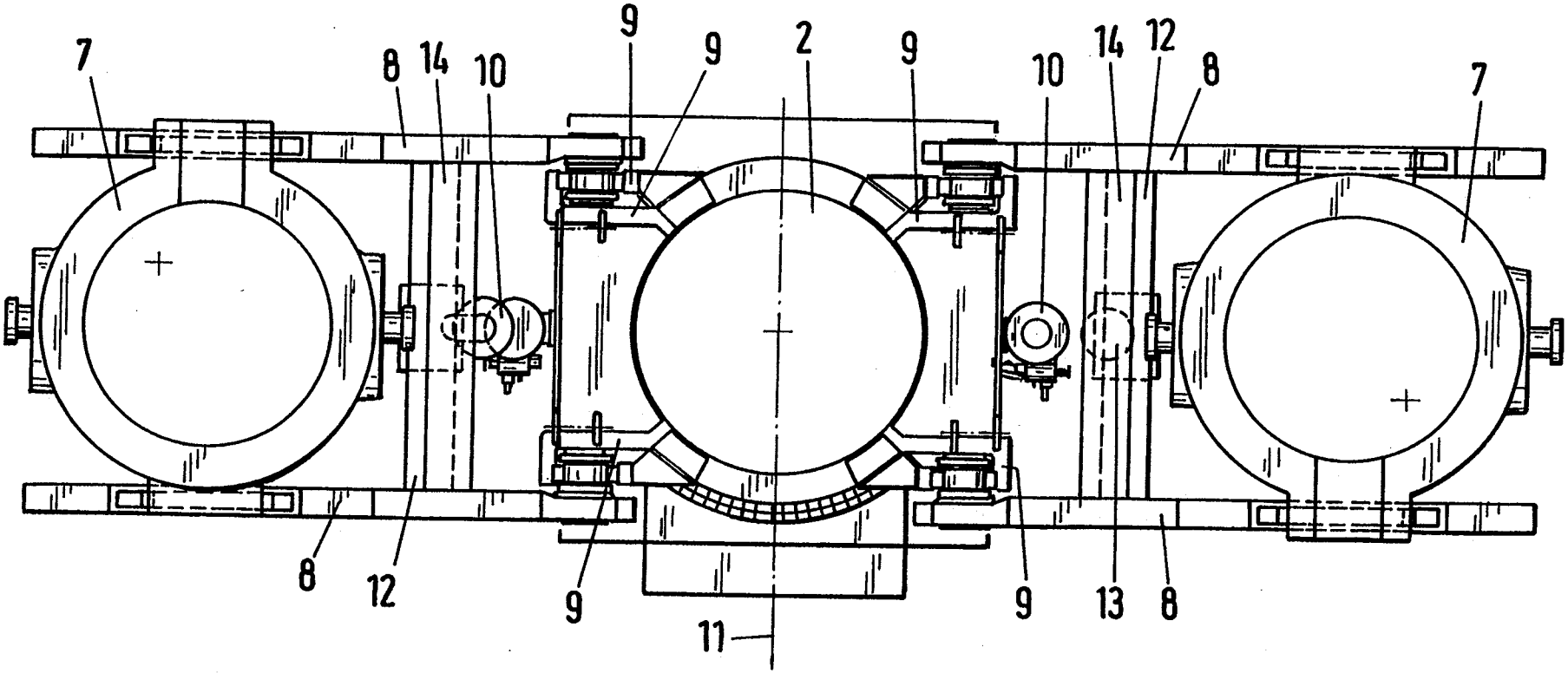
FIG. 3 shows a top view of the transfer station according to FIG. 1.

According to the drawing, a base frame 5 is attached to a column-like foundation 1. A column 2 is supported on the base frame 5 so as to be rotatable on a rotating ring 3. Vertically extending paths 9 are provided at the column 2 and supporting arms 8 for foundry ladles 7 are arranged at these paths 9 so as to be vertically movable. The two paths 9 for receiving the supporting arms 8 carrying a foundry ladle 7 lie opposite one another in a mirror-inverted manner in a plane 11 passing through the axis of the column 2. The paths 9 extend along the height of the column 2 down to the rotating ring 3 where the paths are severed in the plane of the ring. On the side of the plane 11 associated with a take-over position 4, the paths 9 extend from the severance point beyond the base frame 5 as far as the region of the column-like foundation 1 so that the carrying arms 8 can be lowered to the level of the take-over position 4 and receive the foundry ladle 7 delivered to this location.

Each two supporting arms 8, which receive a foundry ladle 7, are connected with one another via a lower cross-piece 12. A lifting device 13 in the form of a hydraulic cylinder is arranged in an upright position below the lower cross-piece 12. The piston rod of the hydraulic cylinder acts on the lower cross-piece 12 and lifts the foundry ladle 7 via the supporting arms 8 along the paths 9 to the height of the rotatable column 2. The paths 9 are interrupted along their vertical dimension in the region of the rotating ring 3 so as not to impede the rotating movement of the column 2. Supporting members 10 in the form of swivelably supported lifting cylinders are arranged at the column 2 so as to be capable of moving out between the supporting arms 8. The lifting cylinders 10 can be swiveled with their piston rod into upper cross-pieces 14 connecting the supporting arms 8 by adjusting means 15 so that the supporting arms 8 can be taken over along with the foundry ladle 7 and brought into the required position for pouring.

Thus, in the take-over position 4, a foundry ladle 7 delivered in the filled state is taken over by a pair of lowered supporting arms 8. The foundry ladle 7 is lifted as far as the region of the column 2 by the lifting device 13, which is a vertically upright hydraulic cylinder whose piston rod engages under the lower cross-piece 12. The foundry ladle 7 is taken over in the region of the column 2 by the revolving turret in that the supporting member 10, a lifting cylinder articulated at the column 2, swivels by way of the adjusting means 15, e.g. a horizontally arranged piston-cylinder unit connecting the lifting cylinder with the column 2, in such a way that the piston rod of the lifting cylinder 10 engages under the upper cross-piece 14.

By rotating the column 2 through 180° the supporting arms 8 swivel with the foundry ladle 7 along a distributing channel, not shown, of a continuous casting installation. The pouring position is adjusted via the distributor by lowering the foundry ladle 7. The pouring position is preferably achieved when the piston rod of the lifting cylinder 10 is moved completely into the cylinder so that the entire weight of the foundry ladle 7 and the supporting arms 8 is supported by the cylinder.

According to a further embodiment of the invention, the point of articulation of the lifting cylinder 10 at the column 2 and the length of the lifting cylinder 10 are selected so that the pouring position of the foundry ladle 7 is achieved when the piston rod of the lifting cylinder 10 is moved in.

Thus, a substantial advantage of the construction according to the invention is that the foundry ladle located in the pouring position can be swiveled into an emergency pouring position in case of disturbance, regardless of whether the second foundry ladle is located in the take-over position or has already been lifted to the level of the pouring position and taken over by the column 2.

The invention is not limited by the embodiments described above which are presented as examples only but can be modified in various ways within the scope of protection defined by the appended patent claims.

We claim:

1. A transfer station for transferring a foundry ladle from a take-over position situated on a shop floor level to a higher pouring position of a curved continuous-casting installation, comprising:

a foundation projecting above the floor level;

a column;

a rotating ring arranged so as to rotatably support the column on the foundation, the rotating ring lying in a horizontal plane and the take-over position being located below the plane of the rotating ring;

vertically movable supporting arms provided at the column so as to receive the foundry ladle;

pairs of vertical guide paths provided diametrically opposite one another on the column so as to vertically guide the supporting arms, said pairs of vertical guide paths extending down to the horizontal plane of the rotating ring;

an additional pair of guide paths provided on a take-over position side of the foundation so as to extend up to the horizontal plane of the rotating ring, the additional pair of guide paths provided at the foundation being alignable with any of the pairs of guide paths provided on the column by rotation of the column;

a hydraulic cylinder arranged below the plane of the rotating ring on the take-over position side of the foundation for vertically moving the supporting arms in the guide paths; and, a supporting member connected to the column so as to be movable laterally outward for supporting the supporting arms, the supporting member being arranged above the plane of the rotating ring and between the paths on the column which guide the supporting arms.

2. A transfer station according to claim 1, wherein the supporting member is a lifting cylinder having a piston rod, and a base that is articulably connected to the column at a point of articulation, and further comprising an upper cross-piece which connects the supporting arms, and adjusting means for swiveling the lifting cylinder so the piston rod of the lifting cylinder engages under the upper cross-piece.

3. A transfer station according to claim 2, wherein the lifting cylinder has a length, the point of articulation of the lifting cylinder at the column and the length of the lifting cylinder being selected so that the pouring position of the foundry ladle is achieved when the piston rod of the lifting cylinder is retracted.

* * * * *